US006152262A

United States Patent [19]

Jung

[11] Patent Number: 6,152,262

[45] Date of Patent: Nov. 28, 2000

[54] LADDER TOP STABILIZER DEVICE

[76] Inventor: Koock E. Jung, 597 Bay Rd., Queensbury, N.Y. 12804

[21] Appl. No.: 09/379,203

[22] Filed: Aug. 21, 1999

[51] Int. Cl.[7] ..... E06C 7/010

[52] U.S. Cl. ..... 182/107; 182/214; 182/172

[58] Field of Search ..... 182/107, 214, 182/172

[56] References Cited

U.S. PATENT DOCUMENTS 5,113,973 5/1992 Southern ..... 182/214

FOREIGN PATENT DOCUMENTS 1137049 7/1982 Canada .

81404 6/1983 European Pat. Off. ..... 182/214

2529611 1/1984 France ..... 182/172

*Primary Examiner*—Alvin Chin-Shue

[57] ABSTRACT

A ladder top safety device for a ladder, as embodied by the invention, is applied to a ladder that comprises side rails and a plurality of rungs interconnecting the side rails. The safety device comprises a plurality of side safety supports that are stored in their stored position in one rung of the plurality of rungs at an upper portion of a ladder. The side safety supports are extendible from the one rung to a stabilizing extended position in which the side safety stabilizers are in contact with a vertical supporting surface when a ladder is placed against a wall supporting surface, such as a wall. Thus, the ladder top stabilizer device provides lateral stabilizing support for the ladder.

11 Claims, 7 Drawing Sheets

LADDER TOP STABILIZER DEVICE

BACKGROUND OF THE INVENTION

The invention relates to a ladder top stabilizer device. In particular, the ladder top stabilizer device prevents top skidding of a ladder and provides top lateral stabilizing for a ladder.

There are two typical styles of ladders presently in use, the extension ladder and the step ladder. The extension ladder generally comprises two or more sections, which are coupled to one another. These sections permit one section to slide vertically relative to the other section. This style of ladder typically has its base, or lower end, resting on a supporting base surface, for example, a ground surface, and its upper end leaning against a stationary object, such as but not limited to a wall or roof eaves.

Extreme care should be exercised when positioning an extension ladder so that a person mounting the ladder does not create an undesirable and potentially harmful force vector. The vector force would tend to cause the top of an extension ladder to slide laterally along the wall. Further, the top or upper end of the extension ladder may slide down the wall. This sliding may be prevented by properly setting the angle that the extension ladder is tilted. Thus, a major force vector caused by the load is primarily directly into the wall.

An extension ladder is often subject to lateral sliding along a wall, especially when the user is stretching out to a side more than he or she should stretch, for example to perform work. That is, rather than getting off the ladder and moving the extension ladder, users often lean laterally outward from the side of the ladder. This leaning can cause unbalancing to the point where the extension ladder may slide along the wall and in worse case situations, tip over sideways. This problem is compounded further when the extension ladder's feet are not resting on a planar, horizontal base surface or the wall is very smooth and does not provide suitable frictional gripping between it and the ladder.

Several devices are known in the art for attempting to stabilize an extension ladder at a bottom of a ladder. These known devices are attached to sides of the extension ladder, either permanently or as a removable attachment to stabilize the base of a ladder. These attached stabilizing devices extend from sides of the ladder and are generally connected to the extension ladder by mechanical connectors.

Few top stabilizing ladder devices are evident. One device, which is shaped like a "U", attaches to a top of a ladder and is intended to space the ladder from the supporting wall. The device is believed to be intended to permit a ladder user to be spaced from the wall to perform work on the wall. This device is not believed to be used for ladder top stabilizing, nor is this device capable of being stored in the ladder. Accordingly, these devices make the ladder bulky, heavier, difficult to carry, manipulate, and store, since it adds to the entire weight, volume, and mass of a ladder.

Therefore, a ladder top portion stabilizing, safety device for an extension ladder that provides top lateral stabilizing is needed. Further, a ladder top stabilizer device that is integrally attached to the extension ladder is needed. Furthermore, a ladder top portion stabilizing, safety device for an extension ladder that provides for lateral stability and support on a wall is needed.

SUMMARY OF THE INVENTION

A top stabilizing device for a ladder, as embodied by the invention, is applied to a top portion of a ladder that comprises side rails and a plurality of rungs interconnecting the side rails. The top stabilizing device comprises a joint and a plurality of side safety supports that are stored in their stored position in one rung of the plurality of rungs, in which the rungs are proximate a top of the ladder when the ladder is extended. The side safety supports are extendible from the one rung at the top of the ladder to a stabilizing extended position in which the side safety stabilizers are in contact with a vertical supporting surface, such as, but not limited to a wall. Thus, the ladder top stabilizer device provides lateral stabilizing support for the ladder top.

Also, the top stabilizing device comprises an optional stabilizing unit that comprises at least one segment, in which each segment is connected to each other by locking devices that lock the segments in their extended position. The optional stabilizing unit further comprises a connector that an operator of the ladder top stabilizer device to connect the optional stabilizing unit to the ladder-top stabilizing, side safety supports.

Further, the top stabilizing device includes a bore detent assembly to position the optional stabilizing device in an extended position. The optional stabilizing device comprises detent recesses in one of the rung of the ladder and the stabilizing, side safety support; and spring-biased locking balls in the other of the rung of the ladder and the stabilizing, side safety support, wherein the stabilizing, side safety support is extended from the rung of the ladder until the spring-biased balls of the bore detent assembly enter the detent recesses to lock the stabilizing, side safety support in the extended position.

Further, each side safety stabilizer of the plurality of side safety stabilizers comprises a plurality of sections. The plurality of sections is in telescoping relationship with each other. The plurality of side safety stabilizers further comprises a retainer to retain each side safety stabilizer in connection with the one rung. The retainer comprising a ball and socket assembly, which comprises a ball on one of the one rung and side safety stabilizer and a socket on the other of the one rung and side safety stabilizer. The safety stabilizer may be extended from the one rung until the ball engages the socket to stop the extension of the side safety stabilizer from the one rung. The side safety stabilizer comprises a plurality of telescoping sections.

Locking mechanisms are disposed between adjacent sections of the plurality of sections. In one aspect of the invention, the locking mechanism comprises a bayonet locking mechanism between adjacent sections, the bayonet locking mechanism comprising at least one channel and at least one slot on one of the adjacent sections, and at least one locking lug on the other of the adjacent sections. The at least one channel and the at least one slot are generally disposed orthogonal to each other, and the at least one locking lug enters the at least one slot in a first direction and then enters the at least one slot in a second direction that is generally orthogonal to the first direction to lock the adjacent sections with each other.

In another aspect of the invention, the locking mechanisms between adjacent sections of the plurality of sections comprise screw threads and locking connectors on adjacent sections of the plurality of sections.

In yet another aspect of the invention, the locking mechanisms between adjacent sections of the plurality of sections comprise spring biased locking detents and cooperating recesses on adjacent sections of the plurality of sections.

In a further aspect of the invention, the locking mechanisms between adjacent sections of the plurality of sections comprise an expandable outer sleeve on one adjacent section and internal actuating device on the other adjacent section, the internal actuating device biasing the sleeve outwardly into an expanded position in which the sleeve is in close frictional engagement with the one adjacent section to lock the adjacent sections with each other.

Another aspect of the invention comprises spring-biased detent locking device for locking sections of the stabilizing, side safety support to each other in their extended position.

Further, another aspect of the invention comprises spring-biased detent locking device for locking the stabilizing, side safety support in its extended position from the rung.

These and other aspects, advantages and salient features of the invention will become apparent from the following detailed description, which, when taken in conjunction with the annexed drawings, where like parts are designated by like reference characters throughout the drawings, disclose embodiments of the invention.

DETAILED DESCRIPTION OF THE INVENTION

Figure 1A:
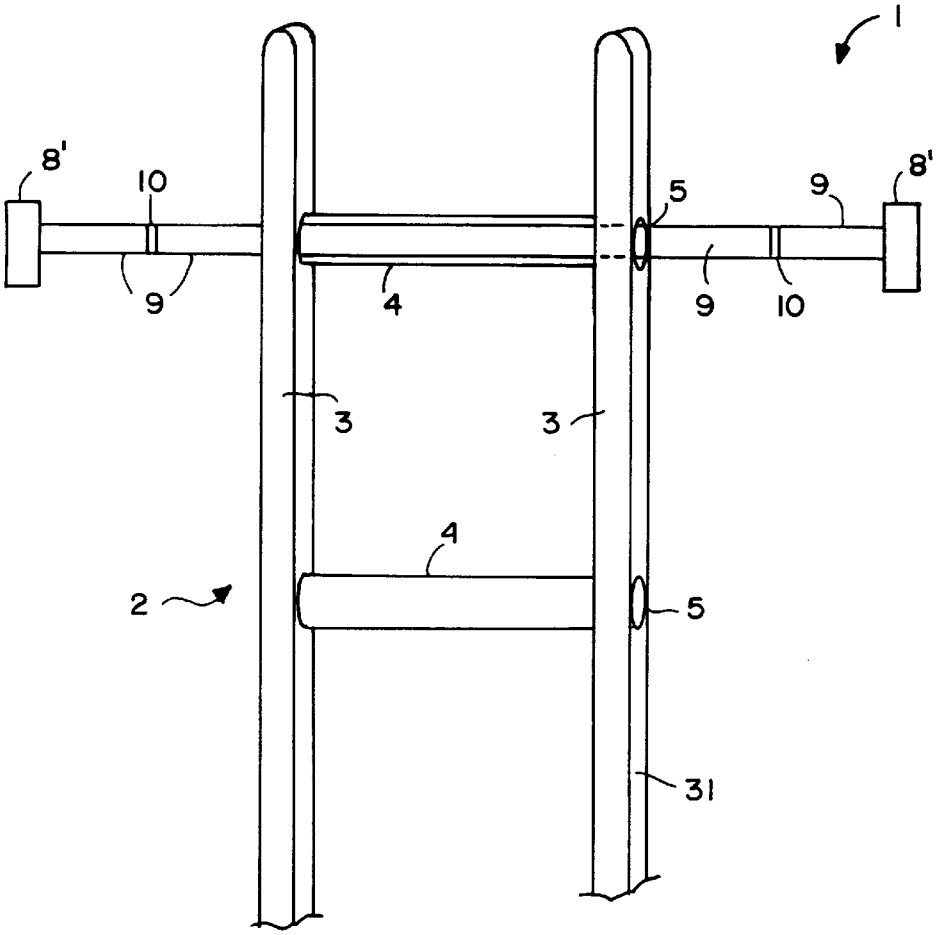
FIG. 1A is a part side, frontal illustration of a ladder top stabilizer device, as embodied by the invention, for a ladder.

A ladder top stabilizer device 1 for a ladder 2 comprises a plurality of ladder-top stabilizing, side safety supports 6 that extend from at least one rung 4 of a ladder 2, as illustrated in FIGS. 1A–1D and 2. The rung 4 of the ladder 2 is disposed proximate the top of the ladder 2, as the ladder 2 is positioned against a surface, such as a wall W, that a person desires to gain access to. The invention will be described with reference to a wall as an exemplary surface that a person wishes to gain access to, however this description is not intended to be limiting of the invention, and other such surfaces are within the scope of the invention. The ladder 2 comprises, but is not limited to, an extension ladder.

The incorporation of the stabilizing, safety device 6 in a rung 4 of a ladder 2 provides for at least one of, and typically a plurality of, enhanced stability, ease of storage and movement of the ladder, enhanced structure integrity, and ease of handling, carrying, and storage. Further, the ladder top stabilizer device 1 prevents backward skidding and provides backward stabilizing of a ladder 2 away from the stationary object against which, one desires to climb. For example, the stationary object is a vertical wall.

The ladder top stabilizer device 1 and the ladder-top stabilizing, side safety supports 6 will now be described with reference to the figures. The ladder top stabilizer device 1 is integrally connected to a ladder 2 so as to present a one-piece, non-removably connected assembly with a ladder 2. The ladder typically comprises an extension ladder, however the scope of the invention comprises inclusion of the ladder top stabilizer device 1 with any ladder, such as but not limited to a step ladder, an extension ladder, a scaffold and ladder combination, and combinations thereof. The invention will be described with reference to an extension ladder 2 (hereinafter "ladder"), however this description is merely exemplary, and is not meant to limit the invention in anyway.

The ladder 2 comprises side rails 3, typically two side rails, and a plurality of rungs 4. The rungs 4 of the ladder 2 are disposed between the side rails 3 in a typical ladder construction. The rungs 4 are connected to each side rail 3 so as to provide structural integrity to the ladder 2, as is known in the art. In other words, the rungs 4 keep the sides 3 of the ladder 2 from moving away from each other.

Figure 2:
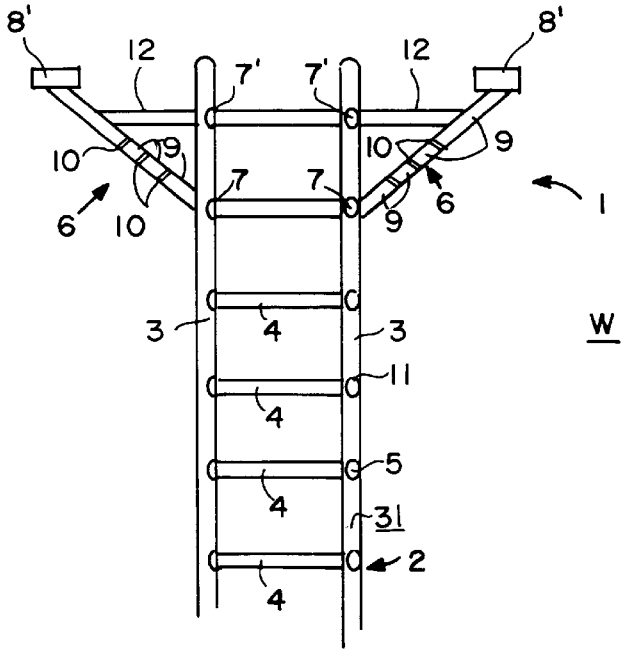
FIG. 2 is a schematic view of a top stabilizing device for a ladder.

The rungs 4 define foot and hand holds for a person who will be climbing the ladder 2. The rungs 4 are typically provided in any appropriate configuration for ease of gripping by hand and standing upon with one's feet. Thus, each rung 4 can be configured with a round cross-section, an oval cross-section, other arcuate cross-section configuration, and with a flat upper surface 11 (FIG. 2).

Each rung 4 is normally provided with a hollow interior 5, which often is exposed and open on outside surfaces 31 of each side rail 3. The hollow interior 5 may comprise any size and shape that can accept the ladder-top stabilizing, side safety supports 6, for example the stabilizing rungs 4 may be larger in diameter than the diameter of the ladder-top stabilizing, side safety supports 6. The hollow interior 5 permits the ladder-top stabilizing, side safety supports 6 to be inserted therein and held therein. The ladder-top stabilizing, side safety supports 6 will be inserted into a rung 4 when in its stored position. The size and shape, such as the cross-sectional size and shape of the ladder-top stabilizing, side safety supports 6 are generally complementary to the size and shape of the cross-sections of the rungs 4, so the ladder-top stabilizing, side safety supports 6 can fit into the rungs 4 in its stored position.

The ladder-top stabilizing, side safety supports 6 are attached to at least one rung 4 of the ladder 2 to define a structurally integral element of the ladder top stabilizer device 1. The ladder top stabilizer device 1 generally comprises two ladder-top stabilizing, side safety supports 6 on each side rail 3. Each stabilizing, side safety support 6 is extendible from a rung 4 at the outside surfaces 31 of the side rails 3 to engage the stationary object, for example a wall.

FIG. 1A illustrates an exemplary version of the ladder top stabilizer device 1, as embodied by the invention. In FIG. 1, the ladder safety device 1 is adapted for use with a ladder 2. In this description and the description of the invention hereinafter, the ladder top stabilizer device 1 is capable of being inserted into a rung 4 of a ladder 2. The ladder top stabilizer device 1 can be provided with the ladder 2 as an integral unit. Alternatively, the ladder top stabilizer device 1 can be provided as a separate unit and then installed into a rung 4 of a ladder 2. If installed into a ladder 2, the ladder top stabilizer device 1 will include assembly features to connect the ladder top stabilizer device 1 in a rung 4 of a ladder 2. For example if the ladder top stabilizer device 1 includes a joint 7 (as described hereinafter) the joint 7 and its associated features are included with the ladder top stabilizer device 1. Thus, the ladder top stabilizer device 1 can be installed into an existing ladder 2, and the purchase of a new ladder 2 is not necessary.

The ladder top stabilizer device 1 of FIG. 1A extends from an interior 5 of the top rung 4 of the ladder 2. The ladder top stabilizer device 1 includes at least one, for example, a plurality of stabilizing, side safety support sections 9. Each section is connected to each other by a locking device 10 (each of which will be described in further detail hereinafter).

The ladder top stabilizer device 1 of FIG. 1A, as embodied by the invention, includes a vertical-wall engaging section 190 with the last section 9. The last section 9 with the vertical-wall engaging section 190 includes a stabilizing leveler 8 that engages a vertical surface or wall to stabilize and support the ladder 2. The last section 9 with the vertical-wall engaging section 190 is angled with respect to the remainder of the sections 9 of the ladder top stabilizer device 1. Thus, the ladder top stabilizer device 1 can be withdrawn from the rung 4 of the ladder 2 with the vertical-wall engaging section 190 facing the wall, so the ladder top stabilizer device 1 contacts the wall to provide stabilizing of the ladder 2.

Figure 1B:
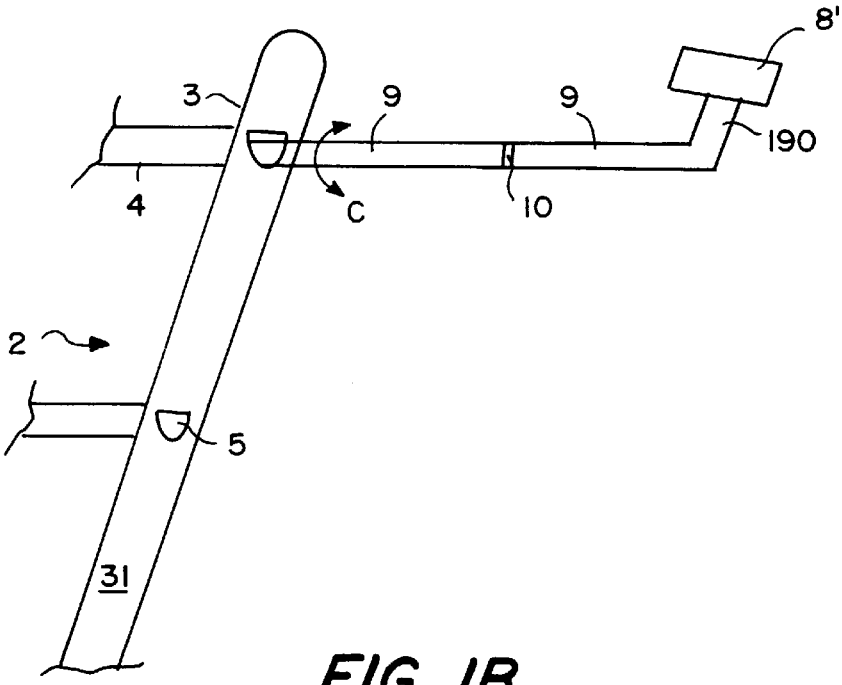
FIG. 1B is a part side, frontal illustration of a ladder top stabilizer device, as embodied by the invention, for a ladder as it extends from a rung of the ladder.
Figure 1C:
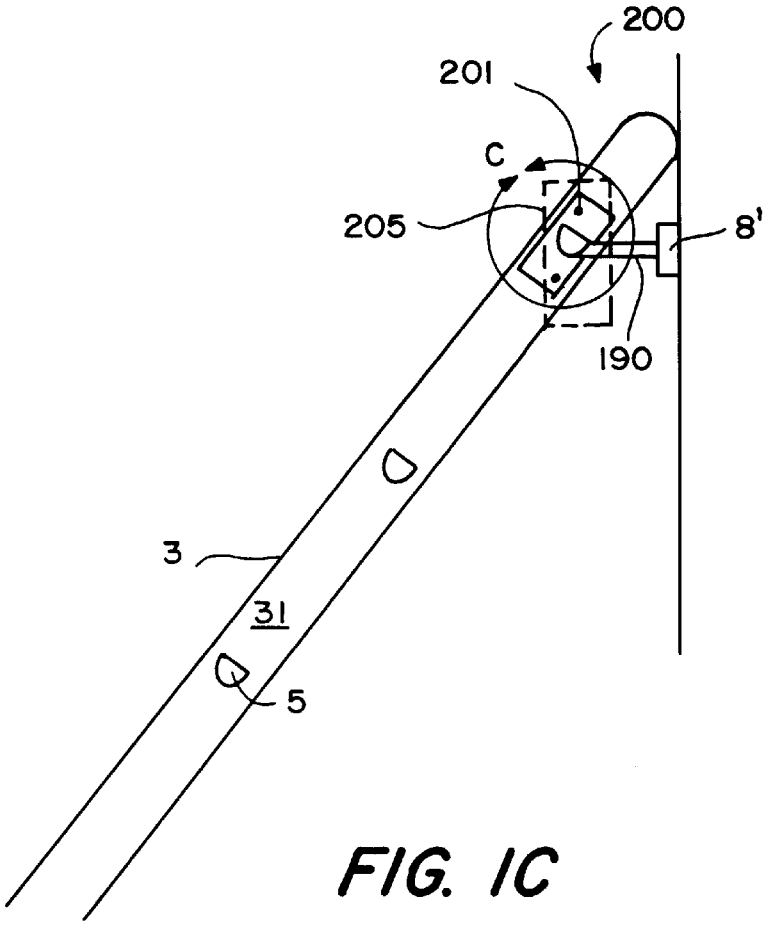
FIG. 1C is a side illustration of a ladder top stabilizer device, as embodied by the invention, for a ladder.

The ladder top stabilizer device 1, as embodied by the invention, that is illustrated in FIGS. 1A–1C is rotatable about the ring 4 from which it extends. As illustrated in these figures, the ladder top stabilizer device 1 can rotate 360° about the axis of the rung 4 as needed to present the stabilizing leveler 8 to the wall against which the ladder 2 is positioned.

Further, as illustrated in FIG. 1C, the ladder top stabilizer device 1 includes a lock structure 200 to lock the ladder top stabilizer device 1 in its extended position. The lock structure 200 includes a lock plate 205 that is illustrated in phantom in a first position and is illustrated in a locked and secured position in solid lines. The lock plate 205 is locked by an appropriate locking structure 201. The locking structure 201 includes, but is not limited to, a locking pin, spring-biased locking projections, bolts, screws, and other such locking structures. The locking structure 201 is similar to the lock structure for the joint 7, as described hereinafter.

Figure 1D:
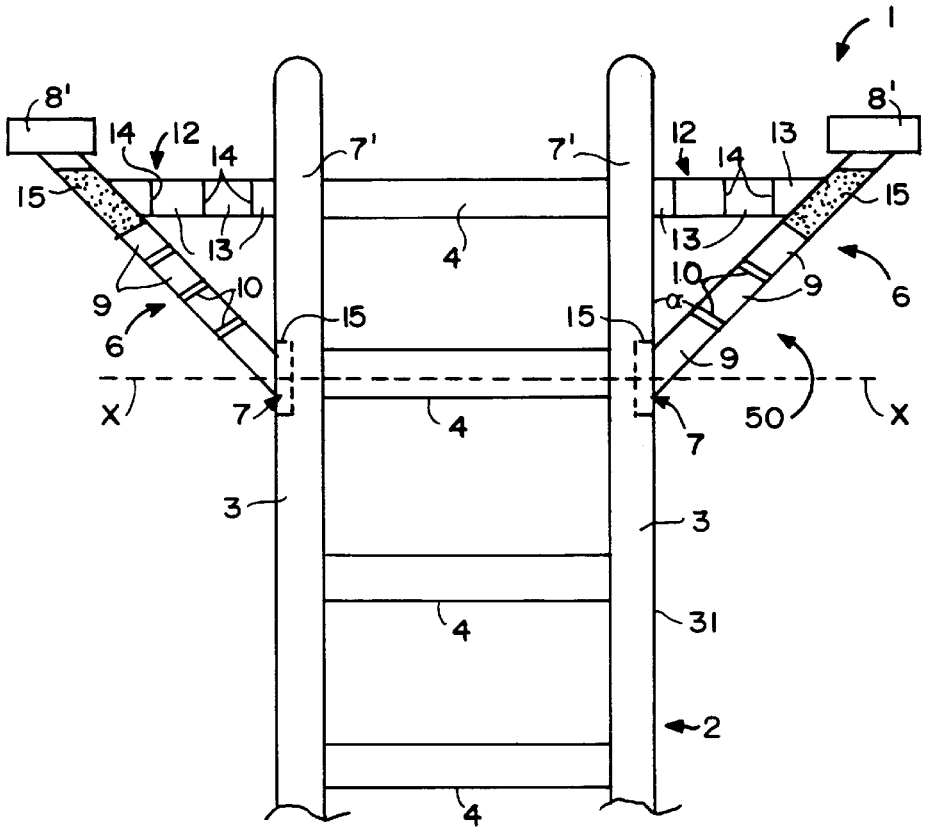
FIG. 1D is a front schematic view of a ladder top stabilizer device, as embodied by the invention, for a ladder.

Alternatively, each stabilizing, side safety support 6 is attached to the ladder 2 by a joint 7, as illustrated in FIGS. 1D and 2. The joint 7 comprises a joint structure that permits pivoting of the ladder-top stabilizing, side safety supports 6 for permitting variance of an angle α, which is the angle defined between the side rail 3 and the stabilizing, side safety support 6 in its extended, stabilizing position (to be described hereinafter), when engaged with the stationary object, such as the wall. The stationary object will hereinafter be referred to as a wall. The embodiment of FIG. 1D provides an enhanced stabilizing function for a ladder, and may provide further enhanced stabilizing with respect to the ladder top stabilizer device 1 of FIG. 1A.

The ladder top stabilizer device 1, as illustrated in FIG. 2, typically comprises two ladder-top stabilizing, side safety supports 6, so that two angles α defined by the ladder-top stabilizing, side safety supports 6 extending from the ladder 2 to the wall are provided thereby. The angles α of each ladder-top stabilizing, side safety supports 6 may be equal or unequal depending the orientation of the ladder 2, the positioning of the wall with respect to the ladder 2 and the degree of movement about the joint 7 into the plane of the sheet of FIG. 1 that is necessary to engage the wall. The joint 7 permits movement of the stabilizing, side safety support 6 so the ladder-top stabilizing, side safety supports 6 stabilize the ladder 2 when the ladder top stabilizer device 1 is in its extended, stabilizing position.

Figure 3:
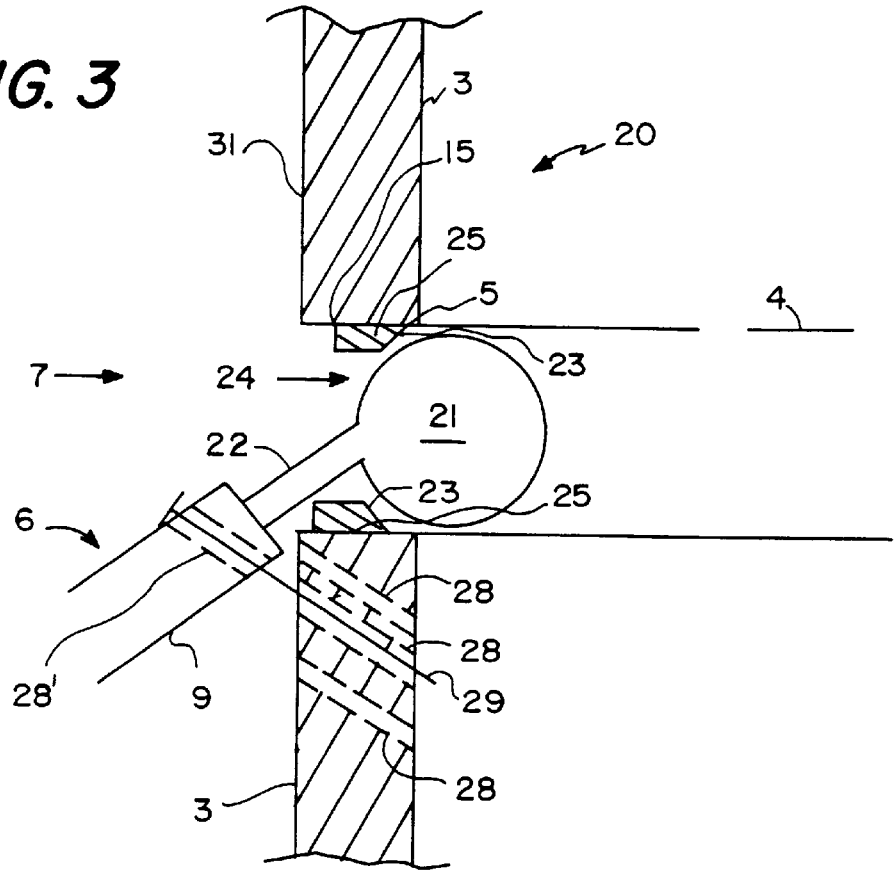
FIG. 3 is a detailed schematic view of an exemplary joint and top stabilizing device at a ladder rung for a ladder.

FIG. 3 illustrates is a close-up view of a joint 7. The joint 7 comprises any joint structure that permits variance of the angle α, positioning of the ladder-top stabilizing, side safety supports 6 to engage the wall, and provide lateral stability of the ladder-top stabilizing, side safety supports 6. For example, as illustrated in FIG. 1, the ladder-top stabilizing, side safety supports 6 can be pivoted about an axis X of the rungs 4 essentially in a full circle of about 360°, as illustrated by the arrow 50 in FIG. 1. The joint 7, as illustrated in FIG. 3, comprises a ball-and-socket joint 20. The illustrated ball-and-socket joint 20 is merely exemplary of a joint structure, and other joint structures are within the scope of the invention.

In FIG. 3, the ball-and-socket joint 20 comprises a block 25 within a recess 15 in side rail 3. The block 25 defines a seat 23 that is disposed within the interior 5 of a rung 4. The seat 23 defines an opening 24 of a first size. The ladder-top stabilizing, side safety supports 6 comprise a plurality of stabilizing, side safety support sections 9 (hereinafter referred to as "sections 9" and that will be described more detail hereinafter). The section 9 that is disposed closest to the side rails 3 of the ladder 2 is a "first section" and comprises a connection to the ball-and-socket joint 20. The connection to the ball-and-socket joint 20 typically comprises a ball 21 that is connected to the first section by a connector 22. The ball 21 is formed in a second size that is smaller than the first size. Therefore, the ball 21 will not be able to be withdrawn through the opening 24 from the block 25 through the seat 23. The ladder-top stabilizing, side safety supports 6 will not be able to be withdrawn from the ladder top stabilizer device 1 and ladder 2, and the ladder-top stabilizing, side safety supports 6 form an integral, one-piece, unitary unit. The ball 21 is freely capable of being slid in the rung and comprises a size and shape complementary to the size and shape of the rung 4. Further, the ball 21 can be coated in a self-lubricating coating to facilitate sliding of the ball 21 within the rung 4.

Each respective joint 7 can further comprise a lock structure to maintain the ladder-top stabilizing, side safety supports 6 in its extended position. Thus, the joint 7 is not movable when extended and engaging a wall. In FIG. 3, the lock structure for a joint 7 comprises at least a plurality of bores 28 in the side rails 3 and bores 28' in one of the sections 9. The bores 28 and 28' are aligned when the ladder-top stabilizing, side safety supports 6 ladder-top stabilizing, side safety supports 6 have been pivoted to their extended position. A lock pin 29 is positionable in the bore or bores 28 and 28' to lock the joint 7 and ladder-top stabilizing, side safety supports 6 in their extended position. The position of the bores 28 and 28' and pin 29, as illustrated, are merely exemplary, and is not intended to limit the invention in any manner.

The sections 9 (FIGS. 1A–1D and 2) of the ladder-top stabilizing, side safety supports 6 of the ladder top stabilizer device 1 are interconnected and extendible from their stored position in the rungs 4 to their extended position for engaging a wall. For example, each section 9 of a ladder-top stabilizing, side safety supports 6 has a different diameter so as to fit inside one another, such as in a telescoping relationship. The lengths of each section of the ladder-top stabilizing, side safety supports 6 can have any appropriate length depending on the intended use of the ladder top stabilizer device 1. The following description of the invention, as embodied by the invention, will refer to a telescoping relationship for the sections 9 of the ladder-top stabilizing, side safety supports 6. This relationship is merely exemplary, and is not intended to limit the invention in any way.

The ladder top stabilizer device 1 further comprises an optional stabilizing unit 12. The optional stabilizing unit 12 (hereinafter "stabilizing unit 12") is disposed in a rung 4 of the ladder that is disposed above the rung 4 in which the ladder-top stabilizing, side safety supports 6 are disposed. The optional stabilizing unit 12 is disposed in a rung 4 that is disposed above the rung 4, for example the optional stabilizing unit 12 is disposed in a rung that is positioned at least one rung above the rung in which the ladder-top stabilizing, side safety supports 6 are disposed.

The optional stabilizing unit 12 comprises at least one segment 13. For example, the optional stabilizing unit 12 comprises a plurality of segments 13. The segments 13 are connected to each other by locking devices 14 that lock the segments 13 in their extended position. The optional stabilizing unit 12 further comprises a connector 15 that is used by an operator of the ladder top stabilizer device 1 to connect the optional stabilizing unit 12 to the ladder-top stabilizing, side safety supports 6. The connector 15 comprises any appropriate connector, including but not limited to ties, cords, chains, locking links, mechanical elements including bolts, screws, pins and the like.

Figure 3A:
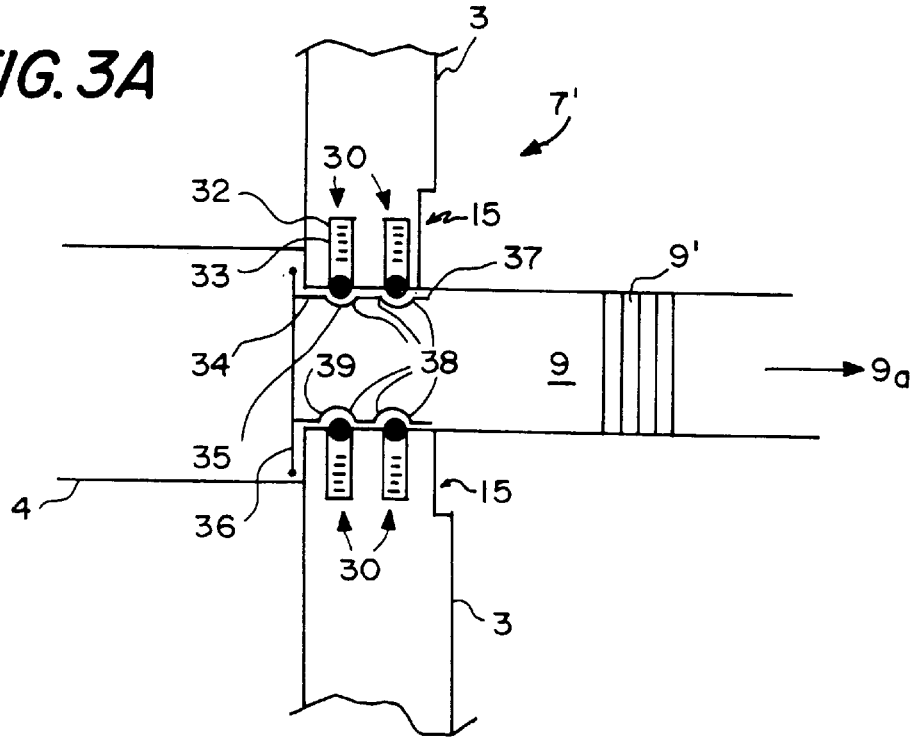
FIG. 3*a* is a detailed schematic view of another exemplary joint and top stabilizing device at a ladder rung for a ladder.

FIG. 3*a* illustrates a further structure for a joint 7' that permits extension of the optional stabilizing unit 12 from a rung 4 of the ladder top stabilizer device 1. The joint 7' comprises a bore detent assembly 30. The bore detent assembly 30 comprises at least one bore 32 that is positioned in the side rails 3 of a ladder 2. FIG. 3*a* illustrates opposed sets of two bores 32 each, however this structure of the joint 7' is merely exemplary, and is not intended to limit the invention in any manner.

In FIG. 3*a*, a spring 33 is positioned in each bore 32 so as to bias a locking ball 33 in a direction out of the bore 31. The last segment 13 of the optional stabilizing unit 12 to be withdrawn from the rung 4 in the extended position of the optional stabilizing unit 12 supports 6 comprises a plurality of detent recesses 35. Each detent recess 35 comprises a front slanting wall 38 that permits ingress and egress of the ball 34 from the recesses 35. The last recess 35 of the bore detent assembly 30 comprises a generally vertical wall 39 that prevents the ball 34 from being withdrawn from the recess 35. Therefore, the bore detent assembly 30 maintains the segment 13 in a locking position to stabilize the ladder 2.

FIG. 3*a* illustrates opposed sets of two detents 35 each, however this structure of the joint 7' is merely exemplary, and is not intended to limit the invention in any manner. The number and positioning of the detents 35 are complementary to the number and positioning of the bore detent assemblies 30. Further, the last segment 13 of the optional stabilizing unit 12 to be withdrawn from the rung 4 in the extended position of the optional stabilizing unit 12 can comprise an end plate 36. The end plate 36 is formed in a size that is larger that an opening 37 of the rung 4 at the side rails 3. Thus, the last segment 13 of the optional stabilizing unit 12 cannot be extended out of the rung 4 because the end plate 36 will contact the side rail 3 at the opening 37, and further extension of the segment 13 will not be possible. Furthermore, in the following description, the bores 32 of the bore detent assembly 30 may be provided on one of the side rails 3 of the ladder 2 and last segment 13 and the recesses 35 can be positioned in the other of the of the side rails 3 of the ladder 2 and last section 9.

In operation, the last segment 13 of the 32 is extended from the rung 4 for engaging the wall with the spring biased balls 34 being biased out of the bore 33. The extension of the last segment 13 continues until the spring biased balls 34 are forced into a recess 35 at which time the balls 34 are locked in the recesses 35. Further withdrawal and extension of the optional stabilizing unit 12 is prevented by the wall 39 of the recess being essentially vertical and to prevent further movement of the segment 13. The user of the ladder top stabilizer device 1 can then connect the optional stabilizing unit 12 to their respective ladder-top stabilizing, side safety supports 6 using the connector 15.

A recess 15 the side rails 3 is sized to receive each stabilizing levelers 8, which engage the wall, when the ladder-top stabilizing, side safety supports 6 are in their stored position inside the rungs 4. A stabilizing leveler 8 of the ladder-top stabilizing, side safety supports 6 is disposed on a last section 91 of the ladder-top stabilizing, side safety supports 6 for engaging the wall. The stabilizing leveler 8 can add to or decrease the overall length of each ladder-top stabilizing, side safety support 6. For example, the stabilizing leveler 8 can comprise any known stabilizing leveler, such as but not limited to a block of material that is screw threaded, as illustrated in FIG. 4.

Figure 4:
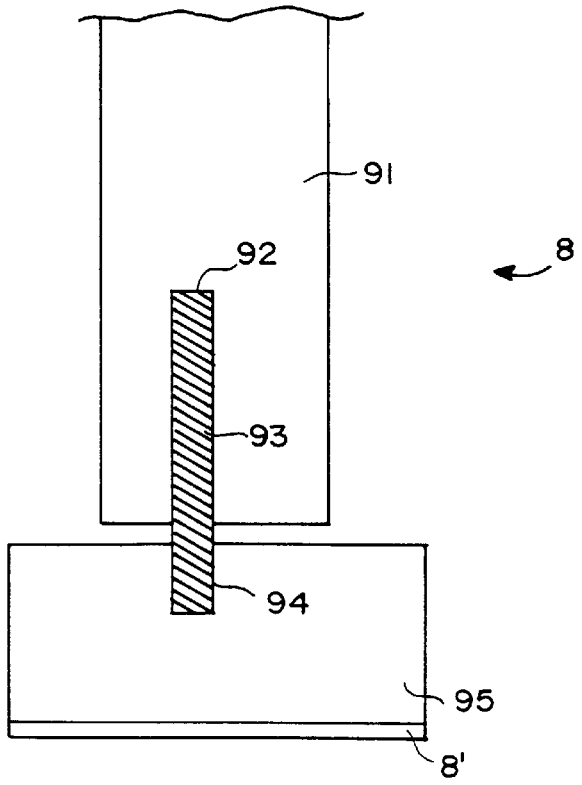
FIG. 4 is a schematic view of an exemplary stabilizing leveler, as embodied by the invention.

In FIG. 4, a stabilizing leveler 8 is schematically illustrated in an exemplary non-limiting form. The illustrated exemplary stabilizing leveler 8 comprises a threaded bore 92 in the last section 91 of a stabilizing, side safety support 6. A threaded connector 93 is fit into the threaded bore 92. The depth of insertion of the threaded connection into the threaded bore 92 can be varied so as to vary its extension from the last section 91 for engaging the wall. The threaded connector 93 can be fit into a threaded bore 94 in a stabilizing base 95. The threaded connector 93 can be connected into the threaded bore 94 to vary the depth of insertion and the overall length of extension of the stabilizing leveler 8. Thus, the stabilizing leveler 8 can adjust the length of the ladder-top stabilizing, side safety supports 6 in which it can engage the wall, such as irregular or un-level wall, and stabilize the ladder 2. The stabilizing leveler 8 can further include a friction increasing member 8'. The friction increasing member 8' comprises any member that can increase the friction between the ladder-top stabilizing, side safety supports 6 and the wall. For example, the friction increasing material 8' can comprise a rubber member. Therefore, when the stabilizing leveler 8 engages the wall, the friction increasing member 8' further enhances the stabilizing feature of the invention.

Figure 5A:
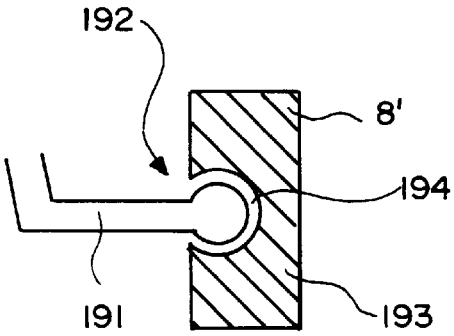
FIG. 5A is a side, part sectional illustration of a stabilizing leveler, as embodied by the invention.
Figure 5:
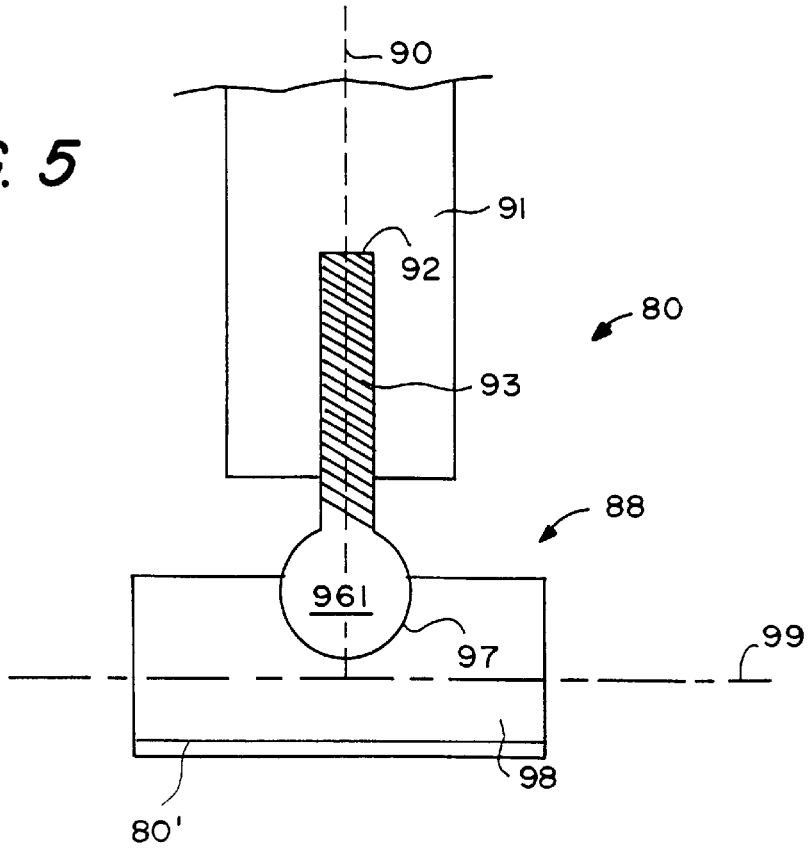
FIG. 5 is a schematic view of another exemplary stabilizing leveler, as embodied by the invention.

Alternatively, the stabilizing leveler 80 can comprise a ball and socket assembly 88 with a stabilizing base 98 as illustrated in FIG. 5 for engaging the wall. In the stabilizing leveler 80, as illustrated in FIG. 5, the stabilizing base 98 comprises a longitudinal axis 99 that is movable with respect longitudinal axis 90 of the last section 91. As illustrated in FIG. 5, the stabilizing leveler 80 comprises a threaded bore 92 in a last, terminating, most-remote section 91 of a ladder-top stabilizing, safety support 6. A threaded connector 93 is fit into the threaded bore 92 and its depth of insertion into the threaded bore 92 can be varied to change its length of extension from the last section 91 for engaging the wall. The end of the threaded connector 93, which is remote from the last section 91, comprises a ball 96 of the ball and socket assembly 88. The ball 96 is inserted into a socket 97 of the stabilizing base 98 in a non-removable fit, so the stabilizing base 98 is pivotable about the ball and socket assembly 88 for engaging the wall. Thus, the stabilizing leveler 80 can move for engaging the wall that may be irregular and unleveled to stabilize the ladder 2. The stabilizing leveler 80 can further include a friction increasing member 80'. The friction increasing member 80' comprises any member that can increase the friction between the ladder-top stabilizing, side safety supports 6 and the wall. For example, the friction increasing member 80' can comprise a rubber material. Therefore, when the stabilizing leveler 80 engages the wall, the friction increasing member 80' further enhances the stabilizing feature of the invention.

FIG. 5A illustrates a further configuration of the stabilizing leveler 8, as embodied by the invention. The configuration of the stabilizing leveler 8 as illustrated in FIG. 5A is shown with the vertical-wall engaging section 190, however this illustration is merely exemplary. The configuration of the stabilizing leveler 8 in FIG. 5A can be used with other ladder top stabilizer devices within the scope of the invention. In FIG. 5A, the stabilizing leveler 8 comprises a ball-and-socket connection 192. The ball-and-socket connection 192 comprises a ball 193 and a complementary socket 194. The vertical-wall engaging section 190 is illustrated comprising the ball 193 and the stabilizing leveler 8 comprises the socket 194, however the ball may be disposed on the stabilizing leveler 8 and the socket 193 may be disposed on the vertical-wall engaging section 190. The ball-and-socket connection 192 permits the ladder top stabilizer device 1 to satisfactorily stabilize the ladder 2 against the wall.

The ladder-top stabilizing, side safety supports 6 may be positioned in any rung 4 of the ladder 2. The materials, length, shape, configuration, and characteristics of the ladder-top stabilizing, side safety supports 6 will vary depending on the location of the rung 4 on the ladder 2. For example, if the ladder-top stabilizing, side safety supports 6 are located on an topmost rung (FIGS. 1A–1D), the ladder-top stabilizing, side safety supports 6 may comprise only one section 9 that can be extended from the rung. If the ladder-top stabilizing, side safety supports 6 are extendible from other rungs 4 of the ladder 2 that are not the topmost rung, the ladder-top stabilizing, side safety supports 6 may comprise a plurality of sections 9 for engaging the wall. Accordingly, the lengths of the sections 9 can vary in length depending on the intended use of the ladder top stabilizer device 1 and are fit in the interior of the rung 4. Also, the scope of the invention comprises positioning of the ladder-top stabilizing, side safety supports 6 that may be in different rungs 4 of a ladder 2 for engaging the wall. For example, one ladder-top stabilizing, side safety supports 6 may be positioned in one rung and another stabilizing, side safety support 6 can be positioned in another rung of the ladder for engaging the wall. Further, the illustrated configuration of the ladder top stabilizer device 1, in which the ladder-top stabilizing, side safety supports 6 extend from one rung 4 for engaging the wall, is also within the scope of the invention.

The lengths of one or all of the sections 9 of the ladder-top stabilizing, side safety supports 6 may vary for engaging the wall. One or all of the sections 9 can be changed by a user of the ladder top stabilizer device 1 to change the total length of the ladder-top stabilizing, side safety supports 6 for engaging the wall. The total length of the ladder-top stabilizing, side safety supports 6 can be changed for any reason, such as to adequately engage the wall that supports the ladder 2.

Each section 9 of the ladder-top stabilizing, side safety supports 6 and each segment 13 of the optional stabilizing unit 12 is lockable with each other by a locking device 10 and 14, respectively. The locking device 10 in its locked position comprises structure that prevents relative movement of the sections 9 and segments 13 with respect to each other when the ladder-top stabilizing, side safety supports 6 and/or each segment 13 of the optional stabilizing unit 12 is in an extended position for supporting and stabilizing the ladder 2. The locking device 10 in its unlocked position permits movement of the sections 9 and segments of the ladder-top stabilizing, side safety supports 6 and/or each segment 13 of the optional stabilizing unit 12 to move the sections 9 and segments of the ladder-top stabilizing, side safety supports 6 and/or each segment 13 of the optional stabilizing unit 12 into a rung 4 in its stored position.

The locking devices 10 and 14 of the ladder-top stabilizing, side safety supports 6 and/or each segment 13 of the optional stabilizing unit 12 comprise an assembly that is easily operated by a user to permit locking and unlocking of the ladder-top stabilizing, side safety supports 6 and/or each segment 13 of the optional stabilizing unit 12 for engaging the wall. Therefore, extension, retraction and movement of the ladder-top stabilizing, side safety supports 6 and/or each segment 13 of the optional stabilizing unit 12 into a rung 4 is possible. Examples of some locking devices 10 and 14 assemblies within the scope of the invention will now be discussed with respect to FIGS. 6–12. These examples are merely exemplary of the locking devices within the scope of the invention, and are not intended to limit the invention in any manner.

Figure 6:
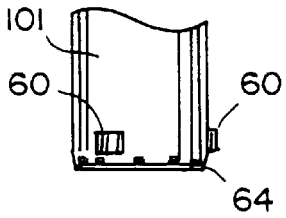
FIG. 6 is a sectional view illustrating a bayonet-type locking device, as embodied by the invention.
Figure 7:
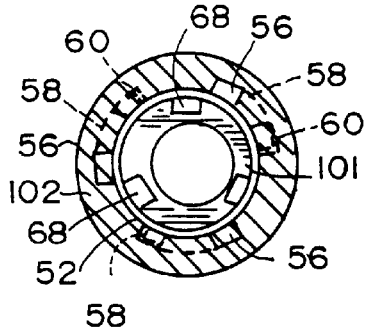
FIG. 7 is a side, sectional view taken on line 7—7 of FIG. 6.
Figure 8:
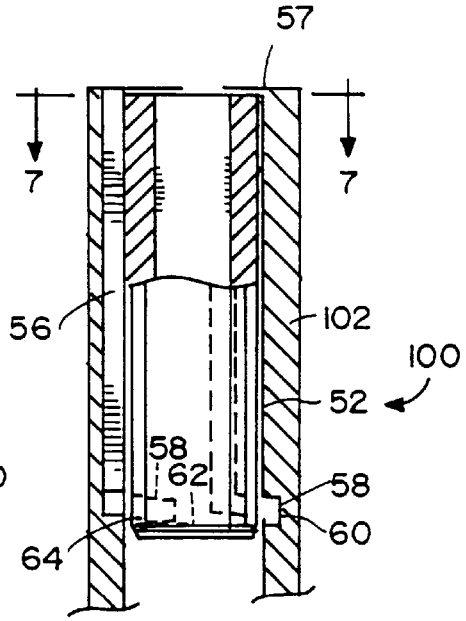
FIG. 8 is a side, sectional view of a lower end of the bayonet-type locking device, as embodied by the invention.

One exemplary locking device 10 and 14 that comprises a bayonet-type locking device 100 (hereinafter referred to as "bayonet-connection locking device"), as embodied by the invention, is illustrated in FIGS. 6–8. The bayonet-connection locking device 100 comprises at least one lug 60 that cooperates with at least one slot 58 on cooperating, adjacent first and second sections 101 and 102 of each ladder-top stabilizing, side safety support 6 and/or each segment 13 of the optional stabilizing unit 12. The bayonet-connection locking device 100 illustrated in FIGS. 6–8 shows lugs 60 on a first section 101 and slots on a cooperating, adjacent second section 102. The first section 101 is nested in the second section 102 in a telescoping nature. The scope of the invention includes lugs and slots on either of two cooperating, adjacent sections 101 and 102 of the ladder-top stabilizing, side safety supports 6 and/or each segment 13 of the optional stabilizing unit 12. Accordingly, as embodied by the invention, the structure and features disposed on one section 101 may be disposed on the other section 102 and the structure and features disposed on the section 102 may be disposed on the section 101, and the discussion of features of each section may apply to the other section.

The cooperating, adjacent section, section 101 is secured in a bore 52 of the other section 102 by the bayonet connection 100. The section 101 comprises a step 55 in a first diameter that separates a larger diameter portion of the bore 52 from a lower portion of the bore 52. The larger diameter of the bore 52 comprises a series of spaced, parallel grooves or bayonet channels 56 that extend along the length of the bore 52 from an upper end 57 of the section 102. The section 101 may comprise cooperating, similarly shaped structure to the spaced, parallel grooves or bayonet channels 56 to prevent undesired rotation of the sections 101 and 102. A downwardly inclined, transverse locking slot 58 extends in a generally circumferential direction from the lower end of each channel 56. The inclined, traverse locking slot 58 comprises a detent at its lowermost end. In FIGS. 6–8, three bayonet channels 56 are illustrated, however this is merely exemplary and not meant to limit the invention in any manner. The scope of the invention comprises a greater or lesser number of bayonet channels, if desired.

Section 101 comprises a plurality of spaced bayonet lugs 60 that project from its outer surface adjacent the lower end 62 of the section, for sliding engagement along the bayonet channels 56 as the section 101 is inserted into the bore 52 of section 102. The structure, as illustrated, shows three such lugs 60, however this is merely exemplary and not meant to limit the invention in any manner. The scope of the invention comprises a greater or lesser number of lugs, if desired.

Each lug 60 may comprise a slight incline or ramped lower surface. Once the lugs 60 enter the lower ends of the respective channels 56, the section is rotated in a clockwise direction. Therefore, the lugs 60 travel along transverse slots 58. Also, at the same time, the section 101 is urged axially downwardly, due to the incline of the slots 58 and the ramped lug surfaces. The section 101 is rotated until each lug reaches the detent at the lower end of each slot 58, releasably locking the insert in the bore 52.

Figure 9:
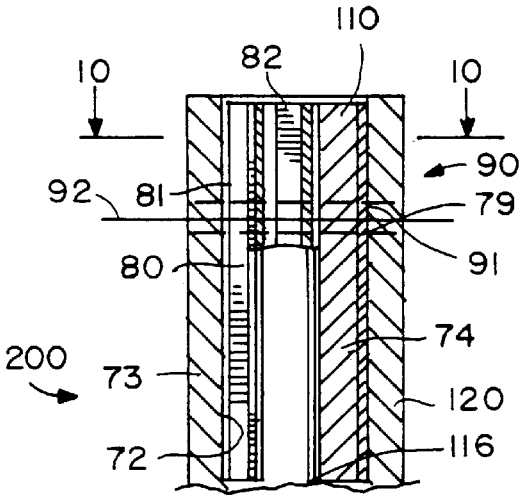
FIG. 9 is an expanding insert for a locking device, as embodied by the invention.
Figure 10:
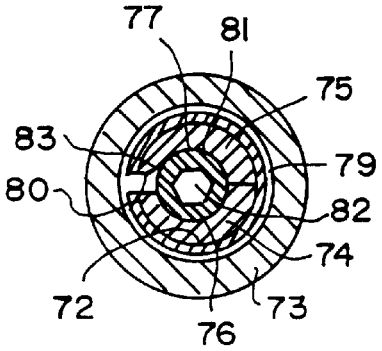
FIG. 10 is a sectional view taken on line 10—10 of FIG. 9, with the expanding insert in an unlocked position.
Figure 11:
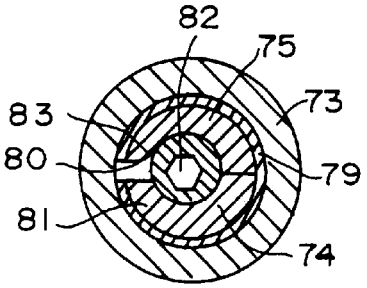
FIG. 11 is a view similar to FIG. 10, with the expanding insert in a locked position.

FIGS. 9–11 illustrate a further alternative locking device 200 for sections 9 and segments 13 of the ladder-top stabilizing, side safety supports 6 and/or each segment 13 of the optional stabilizing unit 12. The locking device 200 locks the sections 110 and 120 of the ladder-top stabilizing, side safety supports 6 and/or each segment 13 of the optional stabilizing unit 12 together. Section 110 of the locking assembly 200 is insertable into a bore 72 of a section member 120. Section 110, as embodied by the invention and illustrated in FIGS. 9–11, comprises two semi-cylindrical half members 74 and 75.

Each of the semi-cylindrical half members 74 and 75 comprise partially semi-circular recesses 76 and 77, which are disposed with respect to other at their mating flat faces. The semi-cylindrical half members 74 and 75 comprise at least partially semi-circular recesses 76 and 77 that together define a through-bore that extends through the section 110. The semi-cylindrical half members 74 and 75 may alternatively be held in a "C"-shaped metal sleeve or sheath 79. The sleeve 79 may be formed with differing wall thicknesses, so that the section 110 can be fit in different diameter bores 72.

One of the recesses 77 comprises an eccentric cut-out 80, which is illustrated in FIGS. 10 and 11. The eccentric cut-out 80 comprises screw threads (not illustrated for ease of understanding) that are in threaded engagement with a central actuating connector 81, such as a screw, (hereinafter referred to as "central actuating connector 81"). The central actuating connector 81 is attached to section 110 to be able to rotate therewith. The central actuating connector 81 comprises a projecting cam surface 83. The projecting cam surface 83 is located in the eccentric cut-out 80 when the central actuating connector screw 81 is in an inoperative position, as illustrated in FIG. 10.

To install and lock the section 110 into the section 120, section 110 is disposed in the bore 82 of section 120. The section 110 is then pushed in a direction that is generally axially downwardly into channel 72. The central actuating connector screw 81 is then rotated in a clockwise direction. The rotation causes the cam surface 83 to move out of cut out 80. The cam surface 83 then urges the semi-cylindrical half members 74 and 75 apart from each other. The semi-cylindrical half members 74 and 75 expand the effective diameter of the section 110, as illustrated in FIG. 11. The outer surface of the expanded sleeve 79 will then bear against the inner surface of bore 72. Frictional engagement between the two surfaces of the sections 110 and 120 will hold and lock the section 110 in the bore 72 of section 120.

As an alternative to the above-described locking device structure, a tapered screw may be used to expand the semi-cylindrical half members 74 and 75. Therefore, the tapered screw gradually increases diameter of the semi-cylindrical half members 74 and 75, and urges the two semi-cylindrical half members apart into a locking position.

Figure 12:
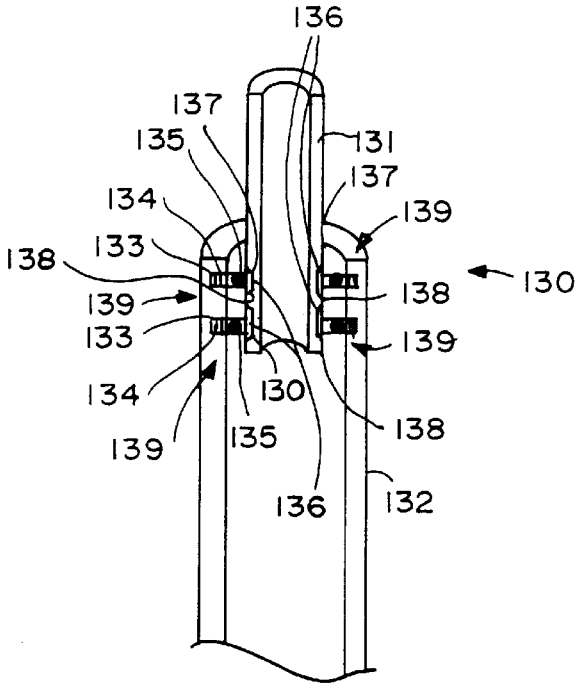
FIG. 12 is another locking device, as embodied by the invention.

FIG. 12 illustrates a further locking device structure 130 for use in the ladder-top stabilizing, side safety supports 6 and/or each segment 13 of the optional stabilizing unit 12. The locking device 130 comprises at least one spring-biased section locking detent assembly 139 to lock sections 131 and 132 of the ladder-top stabilizing, side safety supports 200 in an extended, non-retractable position. Each spring-biased section locking detent assembly 139 comprises a bore 133 that is disposed one of the sections 131 and 132. In FIG. 12, the bore 133 is illustrated disposed in section 132 of the adjacent sections 131 and 132, however this positioning is merely exemplary. The bore 133 can be disposed in either of the sections 131 and 132 with the complementary detent recess structure being disposed in the other of the sections 131 and 132. A spring 134 is positioned in each bore 133 so as to bias a locking ball 135 out of the bore 133. The adjacent sections 131 of the ladder-top stabilizing, side safety supports 6 comprises a plurality of detent recesses 136. FIG. 12 illustrates opposed sets of two detents recesses 136 each, however this structure is merely exemplary, and is not intended to limit the invention in any manner. The number and positioning of the detent recesses 135 are complementary to the number and positioning of the bore detent assemblies 139.

Each recess 136 comprises a front slanting wall 138 that permits ingress and egress of the ball 135 from the recesses 136. The last recess of the bore detent assembly 139 comprises a generally vertical wall 137 that prevents the ball 135 from being withdrawn from the recess 136. Therefore, the bore detent assembly 139 maintains the sections 131 and 132 of the ladder-top stabilizing, side safety supports 6 and/or each segment 13 of the optional stabilizing unit 12 in a locking position to stabilize the ladder 2 for engaging the wall.

Each of the above-described locking devices may further comprise a locking pin assembly 90 that further supports and locks the sections 9 and segments 13 of the ladder-top stabilizing, side safety supports 6 and/or each segment 13 of the optional stabilizing unit 12 in an extended position for engaging the wall. The locking pin assembly 90 of the locking device 200 is illustrated in FIG. 9 for ease of illustration, and although the locking pin assembly 90 can be used on all lock devices within the scope of the invention, and this illustration is not intended to limit the invention in any manner. The locking pin assembly 90 comprises locking mechanisms on adjacent sections of the plurality of sections 9 and segments 13. The locking pin assembly 90 comprises a through hole 91 (in phantom in FIG. 9) aligned in each adjacent section and a cooperating locking pin 92. The locking pin 92 extends through the through hole 91 to lock the adjacent sections with each other. The locking pin assembly 90 maintains the sections in a stable and extended position, and movement between adjacent sections is not possible with the locking pin 90 engaged.

Additional sections 9 and segments 13 of the ladder-top stabilizing, side safety supports 6 and/or each segment 13 of the optional stabilizing unit 12 can be added or removed as needed for changing the overall length of each ladder-top stabilizing, side safety support 6 and/or each segment 13 of the optional stabilizing unit 12 for engaging the wall. Thus, the ladder-top stabilizing, side safety supports 6 and/or each segment 13 of the optional stabilizing unit 12 extend from the ladder 2 and contact the wall or other supporting surface. Segments 13 and sections 9 of a ladder-top stabilizing, side safety support 6 and/or each segment 13 of the optional stabilizing unit 12 may be removed to decrease the length of each stabilizing, side safety support 6 and/or each segment 13 of the optional stabilizing unit 12, so a stabilizing, side safety support 6 and/or each segment 13 of the optional stabilizing unit 12 extends from the ladder 2, can be pivoted, and can contact the wall or other supporting surface.

Figure 13:
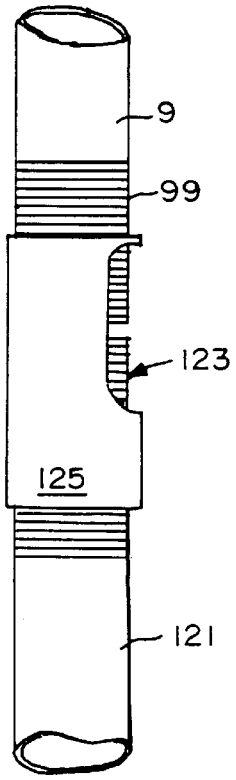
FIG. 13 is a side, part-sectional illustration of a connector that adds an additional section to ladder-top stabilizing, side safety supports of the ladder top stabilizer device, as embodied by the invention.

The overall length of the ladder-top stabilizing, side safety supports 6 and/or each segment 13 of the optional stabilizing unit 12 may be adjusted by a user of the ladder top stabilizer device 1 for engaging the wall. The overall length of the ladder-top stabilizing, side safety supports 6 and/or each segment 13 of the optional stabilizing unit 12 may be decreased or increased by removing at least one section from or adding at least one section from the original sections 9 segments 13 of the ladder-top stabilizing, side safety supports 6 and/or each segment 13 of the optional stabilizing unit 12, respectively for engaging the wall. For example, as illustrated in FIG. 13, an additional section 121 may be added to the ladder-top stabilizing, side safety supports 6 to any original section 9 pr segment 13 of the ladder-top stabilizing, side safety supports 6 and/or each segment 13 of the optional stabilizing unit 12 for engaging the wall. The additional section 121 comprises threads 122 on an end 123 of the section 121. The original section 9 or segment of the stabilizing, side safety support 6 and/or each segment 13 of the optional stabilizing unit 12 comprises threads 99.

An additional section connector 125 connects the original section 9 or segment 13 to the additional section 121. The additional section connector 125 comprises connector threads on an internal surface wherein the additional section connector threads mate with the threads of the original section 9 or segment 13 and additional section 121. Therefore, the additional section 121 can be added to the ladder-top stabilizing, side safety support 6 or and/or each segment 13 of the optional stabilizing unit 12 for engaging the wall. Depending on the length of the additional section connector 125 and the degree of mating for each of the additional section 121 and original section 9 into the additional section connector 125, the overall length of the ladder-top stabilizing, side safety supports 6 and/or each segment 13 of the optional stabilizing unit 12 may be varied by changing the degree of mating and threading into the additional section connector 125.

Figure 14:
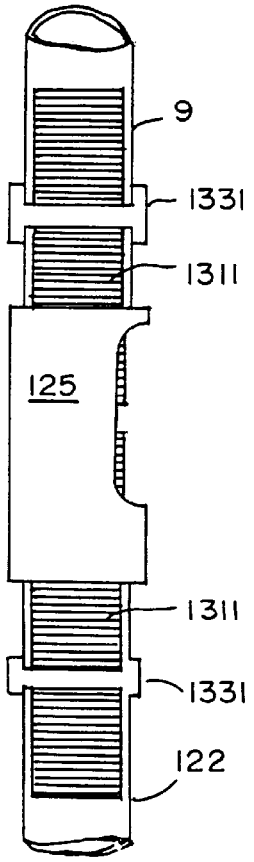
FIG. 14 is a side, part-sectional illustration of another connector that adds an additional section to ladder-top stabilizing, side safety supports of the ladder top stabilizer device, as embodied by the invention.

FIG. 14 illustrates an alternative configuration for adjusting the overall length of the ladder-top stabilizing, side safety supports 6 and/or each segment 13 of the optional stabilizing unit 12 for engaging the wall. The structure of FIG. 14 is similar to that illustrated and described with respect to FIG. 13, and similar reference characters refer to similar elements. In FIG. 14, the original section 9 or segment 13 and the additional section 122 are each provided with a threaded insert 1311. The additional section connector 125 is threadably mated to each threaded insert 1311 so as to be added to an original section 9 of the stabilizing, side safety support 6 and/or each segment 13 of the optional stabilizing unit 12 for engaging the wall. Depending on the length of the additional section connector 125 and the degree of mating of the threaded inserts 1311 to the additional section connector 125, the overall length of the ladder-top stabilizing, side safety supports 6 and/or each segment 13 of the optional stabilizing unit 12 may be varied by changing the degree of mating and threading into the additional section connector 125 for engaging the wall. The threaded connector 1311 can be connected to each respective section by a connector 1331 of any appropriate configuration.

A general description of the operation of the ladder top stabilizer device 1 will now be described with reference to the figures. This description of the operation is merely exemplary, and is not meant to limit the invention in any manner. A user of the ladder top stabilizer device 1 will position the ladder 2 against a stationary object. The user positions the ladder 2 at the desired orientation on the stationary object, and then uses the ladder top stabilizer device 1 to laterally stabilize the ladder 2 for engaging the wall. A user extends the ladder-top stabilizing, side safety supports 6 from rungs 4 of the ladder 2 from its stored position, for example in a telescoping manner to an extended wall engaging stabilized position.

The user first removes the stabilizing levelers 8 from the recesses 15 in the side rails 3. Each ladder-top stabilizing, side safety support 6 is extended to its fully extended position for engaging the wall. Each stabilizing, side safety support 6 is then pivoted about the joint 7, so the stabilizing leveler 8 engages the wall in its extended position. The locking devices 10 on each stabilizing, side safety support 6 are then moved into their locked position. Thus, each section 9 of the stabilizing, side safety support 6 is not moveable with respect to other sections 9 of the stabilizing, side safety support 6. Therefore, the ladder-top stabilizing, side safety supports 6 of the ladder top stabilizer device 1 stabilizes the ladder 2 with respect to the wall, and the user may ascend the ladder 2 relatively certain that the ladder top is stabilized against lateral movement. Further, the locking pin 29 can be inserted into bores 28 in the joint 7 to lock the ladder-top stabilizing, side safety supports 6 in their pivoted and locked position.

The optional stabilizing unit 12 (hereinafter "stabilizing unit 12") is disposed in a rung 4 of the ladder that is disposed above the rung 4 in which the ladder-top stabilizing, side safety supports 6 are disposed. The optional stabilizing unit 12 is disposed in a rung 4 that is disposed above the rung 4, for example the optional stabilizing unit 12 is disposed in a rung that is positioned at least one rung above the rung in which the ladder-top stabilizing, side safety supports 6 are disposed.

The optional stabilizing unit 12 may then be extended from its stored position, that is from a rung of the ladder. The optional stabilizing unit 12 can then be connected to the ladder-top stabilizing, side safety supports 6 by the connector 15.

The materials of the ladder top stabilizer device 1 are materials that provide adequate structural strength. For example, and in no way limiting of the invention, the material of various components of the ladder top stabilizer device 1 and its components include, but are not limited to, metals, alloys, plastics, composites, and combinations thereof.

The scope of the invention comprises interchangeable use of various described embodiments of the invention. For example, differing stabilizing levelers 8, as described herein, can be used separately or in combination with each other. The scope of the invention is not limited to the illustrated structures, and various features disclosed herein are useable with each other.

While embodiments of the invention have been described, the present invention is capable of variation and modification, and therefore should not be limited to the description herein. The invention includes changes and alterations that fall within the purview of the following claims. Individual components of the described and illustrated embodiments may be used interchangeably with each other components of the described and illustrated embodiments.

What is claimed is:

1. A combination of a safety device for a ladder and a ladder, the ladder comprising side rails and a plurality of rungs interconnecting the side rails, the safety device comprising:

a plurality of ladder-top stabilizing, side safety supports that is disposed proximate a top of the ladder; the plurality of side safety supports being connected to the ladder in and at a rung of the ladder at an upper portion of the ladder, each stabilizing, side safety support comprising an elongated member having a joint at one end thereof, and each elongated member and joint being connected to and inserted into and stored in a stored position in one rung of the plurality of rungs that is disposed at an upper portion of the ladder, in the stored position the entire length of the elongated member is substantially inserted within the one rung, in which the one rung comprises a first periphery, the first periphery comprises a non-circular shaped periphery, a periphery of the elongated members comprising a second periphery, the first periphery being larger than the second periphery so that the stabilizing, side safety support can be stored in the one rung, the first periphery of the one rung comprising a shape that is complementary to a shape of the second periphery to provide stability and structural integrity with the first and second peripheries permitting minimal of free play between the one rung and the plurality of stabilizing, side safety supports, the stabilizing, side safety supports being extendible from the stored position in the one rung to a stabilizing extended position in which the elongated members are entirely withdrawn from the one rung and each joint retains the respective elongated member in connection with the one rung, wherein the ladder-top stabilizing, side safety supports are engageable with a vertical surface, wherein the ladder-top stabilizing, side safety supports provide lateral stabilizing support for the ladder, when extended from its stored position in the one rung.

2. A combination according to claim 1, each elongated member comprises a plurality of sections.

3. A combination according to claim 2, wherein the plurality of sections are in telescoping relationship with each other.

4. A combination according to claim 1, wherein each elongated member comprises a plurality of telescoping sections, the device further comprising at least one locking mechanism between adjacent sections of the plurality of sections, wherein the locking device comprises an expandable outer sleeve on one adjacent section and internal actuating device on the other adjacent section, the internal actuating device biasing the sleeve outwardly into an expanded position in which the sleeve is in close frictional engagement with the one adjacent section to lock the adjacent sections with each other.

5. A combination according to claim 4, further comprising at least one bore in the joint and a lock pin that is capable of being inserted into the at least one bore to lock the stabilizing, side safety support in the extended position.

6. A combination according to claim 1, wherein each elongated member comprises a plurality of telescoping sections, the device further comprising at least one locking mechanism between adjacent sections of the plurality of sections, wherein the locking device comprises a through bore in each adjacent section and a locking pin that extends through the through bore in each adjacent section to lock the adjacent sections with each other.

7. A combination according to claim 1, wherein safety device comprises an optional stabilizing unit that comprises at least one segment, each segment being connected to each other by locking devices that lock each segment in its extended position, the optional stabilizing unit further comprises a connector that an operator of the ladder top stabilizer device to connect the optional stabilizing unit to the ladder-top stabilizing, side safety supports.

8. A combination according to claim 7, wherein each joint comprising a bore detent assembly that comprises:

detent recesses in one of the rung of the ladder and the stabilizing, side safety support; and spring-biased locking balls in the other of the rung of the ladder and the stabilizing, side safety support, wherein the stabilizing, side safety support is extended from the rung of the ladder until the spring-biased balls of the bore detent assembly enter the detent recesses to lock the stabilizing, side safety support in the extended position.

9. A combination according to claim 1, wherein each elongated member comprises a plurality of telescoping sections, the device further comprising at least one locking mechanism between adjacent sections of the plurality of sections, wherein the locking mechanism comprises a bayonet locking mechanism between adjacent sections, the bayonet locking mechanism comprises at least one channel and at least one slot on one of the adjacent sections, and at least one locking lug on the other of the adjacent sections, the at least one channel and the at least one slot being disposed generally orthogonal to each other, the at least one locking lug locking lug enters the at least one slot in a first direction and then enters the at least one slot in a second direction, the second direction being generally orthogonal to the first direction, to lock the adjacent sections with each other.

10. A combination of a safety device for a ladder and a ladder, the ladder comprising side rails and a plurality of rungs interconnecting the side rails, the safety device comprising:

a plurality of ladder-top stabilizing, side safety supports that is disposed proximate a top of the ladder; the plurality of side safety side safety supports being connected to the ladder in and at a rung of the ladder at an upper portion of the ladder, each stabilizing, side safety support capable of being connected to and inserted into and stored in a stored position in one rung of the plurality of rungs that is disposed at an upper portion of the ladder, in which the one rung comprises a first periphery, the first periphery comprises a non-circular shaped periphery, a periphery of the stabilizing, side safety supports comprising a second periphery, the first periphery being larger than the second periphery so stabilizing, side safety support can be stored in the one rung, the first periphery of the one rung comprising a shape that is complementary to a shape of the second periphery to provide stability and structural integrity with the first and second peripheries permitting minimal of free play between the one rung and the plurality of stabilizing, side safely supports, the stabilizing, side safety supports being extendible from the stored position in the one rung to a stabilizing extended position in which the ladder-top stabilizing, side safety supports are engageable with a vertical surface, wherein the ladder-top stabilizing, side safety supports provide lateral stabilizing support for the ladder when extended from its stored position in the one rung and positioned in contact with a supporting base service in the stabilizing extended position, the combination further comprising a joint that connects each stabilizing, side safety support to the ladder, wherein the joint retains each side safety stabilizer in connection with the one rung, wherein the joint comprises a ball and socket assembly, the ball and socket assembly comprising a ball on one of the one rung and stabilizing, side safety support and a socket on the other of the one rung and stabilizing, side safety support, wherein each ladder-top stabilizing, side safety supports may be extended from the one rung until the ball engages the socket to stop the extension of the ladder-top stabilizing, side safety supports from the one rung.

11. A combination according to claim 10, wherein the joint comprises a locking pin to maintain the ladder-top stabilizing, side safety supports in the extended position and each stabilizing, side safety support comprises a plurality of telescoping sections.

* * * * *